US010589952B2

(12) United States Patent
Bray

(10) Patent No.: US 10,589,952 B2
(45) Date of Patent: Mar. 17, 2020

(54) TIPPING PAPER FEED ASSENBLY FOR USE IN SMOKING ARTICLE MANUFACTURE

(71) Applicant: British American Tobacco (Investments) Limited, London (GB)

(72) Inventor: Andrew Bray, London (GB)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 415 days.

(21) Appl. No.: 15/315,019

(22) PCT Filed: May 7, 2015

(86) PCT No.: PCT/GB2015/051344
§ 371 (c)(1),
(2) Date: Nov. 30, 2016

(87) PCT Pub. No.: WO2015/185887
PCT Pub. Date: Dec. 10, 2015

(65) Prior Publication Data

US 2017/0190533 A1 Jul. 6, 2017

(30) Foreign Application Priority Data

Jun. 5, 2014 (GB) ..... 1410008.5

(51) Int. Cl.
*B65H 19/18* (2006.01)
*B65H 23/188* (2006.01)

(52) U.S. Cl.
CPC ..... *B65H 19/18* (2013.01); *B65H 19/1826* (2013.01); *B65H 23/188* (2013.01); *B65H 23/1882* (2013.01); *B65H 2801/54* (2013.01)

(58) Field of Classification Search
None
See application file for complete search history.

(56) References Cited

U.S. PATENT DOCUMENTS 3,896,820 A * 7/1975 Ludszeweit ..... A24C 5/20 131/280
4,113,197 A 9/1978 Harrington
(Continued)

FOREIGN PATENT DOCUMENTS

DE 3923163 A1 1/1991
EP 0365470 A2 4/1990
(Continued)

OTHER PUBLICATIONS

International Search Report for corresponding application PCT/GB2015/051344 filed May 7, 2015; dated Jul. 24, 2015.
(Continued)

*Primary Examiner* — Dennis R Cordray
(74) *Attorney, Agent, or Firm* — Cantor Colburn LLP

(57) ABSTRACT

A tipping paper feed assembly (1) for use in smoking article manufacture. The tipping paper feed assembly (1) comprising a first feed device adapted to supply a first tipping paper web (4) that is fed into apparatus for smoking article manufacture, and a second feed device adapted to supply a second tipping paper web (11). The tipping paper feed assembly (1) also comprises a splice mechanism (12) adapted to attach the first and second tipping paper webs (4, 11) together for changeover between the first and the second feed devices. The tipping paper feed device (1) also comprises a registration system configured to register features of each tipping paper web (4, 11) prior to attaching said first and second tipping paper webs together with said features in register.

15 Claims, 3 Drawing Sheets

(56) References Cited

U.S. PATENT DOCUMENTS

| | | | | |
|---|---|---|---|---|
| 4,492,609 | A * | 1/1985 | Blom | B65H 19/10 156/353 |
| 4,579,293 | A * | 4/1986 | Steiniger | B65H 19/1836 226/92 |
| 5,039,374 | A * | 8/1991 | Winter | B65H 19/1836 156/361 |
| 6,422,282 | B1 * | 7/2002 | Meinke | B65H 19/102 156/157 |
| 2005/0066984 | A1 * | 3/2005 | Crooks | A24D 3/043 131/341 |
| 2008/0029111 | A1 * | 2/2008 | Dube | A24C 5/471 131/280 |

FOREIGN PATENT DOCUMENTS

| | | | |
|---|---|---|---|
| EP | 1714927 | A2 | 10/2006 |
| EP | 2295355 | A2 | 3/2011 |
| GB | 2135283 | A | 8/1984 |
| JP | 2000095399 | A | 9/1998 |
| KR | 100357473 | B1 | 4/2003 |
| WO | 200408069 | A2 | 9/2004 |
| WO | 2004080869 | A2 | 9/2004 |

OTHER PUBLICATIONS

Written Opinion of the International Searching Authority for corresponding application PCT/GB2015/051344 filed May 7, 2015; dated Jul. 24, 2015.

Japanese Office Action for Japanese Patent Application No. 2016-0571056; Report dated Dec. 4, 2017.

Korean Office Action for corresponding application 10-2016-7033414; dated Feb. 2, 2018.

* cited by examiner

TIPPING PAPER FEED ASSENBLY FOR USE IN SMOKING ARTICLE MANUFACTURE

TECHNICAL FIELD

This invention relates to a tipping paper feed assembly having a splice mechanism that enables changeover from a first reel of tipping paper web to a second reel of tipping paper web.

BACKGROUND

In cigarette manufacture a tipping paper web is cut into patches which are adhered and wrapped around tobacco and filter rod components to join the tobacco and filter rod components together. The tipping paper is provided as a reel which is unwound into the apparatus for cigarette manufacture by a tipping paper feed assembly.

SUMMARY

In accordance with embodiments of the invention, there is provided a tipping paper feed assembly for use in smoking article manufacture, the tipping paper feed assembly comprising:

- a first feed device adapted to supply a first tipping paper web that is fed into apparatus for smoking article manufacture;
- a second feed device adapted to supply a second tipping paper web;
- a splice mechanism adapted to attach the first and second tipping paper webs together for changeover between the first and the second feed devices; and,
- a registration system configured to register features of each tipping paper web prior to attaching said first and second tipping paper webs together with said features in register.

The tipping paper feed assembly may further comprise an accelerating roller configured to accelerate the second tipping paper web prior to the splice mechanism attaching the first and second tipping paper webs together.

The accelerating roller may be configured to accelerate the second tipping paper web until the speed of the second tipping paper web substantially matches the speed of the first tipping paper web.

The tipping paper feed assembly may further comprise a reservoir into which the second tipping paper web is directed prior to the splice mechanism attaching the first and second tipping paper webs together.

The registration system may comprise a first sensor arranged to detect a feature of the first tipping paper web.

The registration system may comprise a second sensor arranged to detect a feature of the second tipping paper web.

At least one of the first and second sensors may be configured to detect a printed mark. At least one of the first and second sensors may be configured to detect a cut line. At least one of the first and second sensors may be configured to detect an edge.

The first sensor may be disposed to detect the first web of tipping paper downstream of the splice mechanism.

The second sensor may be disposed to detect the second web of tipping paper downstream of the splice mechanism.

The splice mechanism may comprise a first cutter adapted to cut the first tipping paper web during changeover from the first feed device to the second feed device.

The splice mechanism may further comprise a second cutter adapted to cut off excess material from the second tipping paper web during changeover from the first feed device to the second device.

The splice mechanism may attach the first and second tipping paper webs together using tape or adhesive or heat.

According to another aspect of the invention, there is provided apparatus for smoking article manufacture comprising the tipping paper feed assembly described above.

The apparatus for smoking article manufacture may further comprise a tipping unit adapted to assemble smoking articles. The tipping unit may be adapted to cut the tipping paper web into tipping paper patches and wrap those tipping paper patches around smoking article components. For example, the tipping unit may be adapted to wrap the tipping paper patches around tobacco rods and filter rods to join the tobacco and filter rods together to form smoking articles.

According to a further aspect of the invention, there is provided a method of assembling smoking articles comprising:

- feeding a first tipping paper web from a first feed device to a tipping unit adapted to assemble smoking articles;
- attaching first and second tipping paper webs together for changeover from the first feed device to a second feed device that feeds said second tipping paper web; and,
- registering a feature of each tipping paper web prior to attaching the said first and second tipping paper webs together in register.

The tipping unit may be adapted to cut the tipping paper web into tipping paper patches and wrap those tipping paper patches around smoking article components. For example, the tipping unit may be adapted to wrap the tipping paper patches around tobacco rods and filter rods to join the tobacco and filter rods together to form smoking articles.

The method of assembling smoking articles may further comprise accelerating the second tipping paper web prior to attaching the first and second tipping paper webs together.

According to a further aspect of the invention, there is also provided a smoking article manufactured using the tipping paper feed assembly described above, the apparatus described above, or the method described above.

BRIEF DESCRIPTION OF THE DRAWINGS

Embodiments of the invention will now be described, by way of example only, with reference to the accompanying drawings, in which.

DETAILED DESCRIPTION

Apparatus for smoking article manufacture comprises a tipping paper feed assembly that supports a reel of tipping paper web, which is unwound and fed into subsequent apparatus. The subsequent apparatus cuts the tipping paper web into patches for wrapping around the tobacco and filter rod components to form smoking articles.

In various embodiments, a splice mechanism is provided to allow the tipping paper feed assembly to change from a first reel of tipping paper web to a second reel of tipping paper web without having to slow or stop the tipping paper web moving through the subsequent apparatus. Therefore, smoking articles can continue to be manufactured while the tipping paper feed assembly changes from a first reel to a second reel.

Some tipping paper webs may include features, such as a printed pattern or cut-out. According to various embodiments, a registration system is provided that registers a position of a feature of the first tipping paper web to a position of a feature of a second tipping paper web prior to changing from the first reel to the second reel. Therefore, the tipping paper web passing through the subsequent apparatus will have a continuous and aligned pattern. That is, the pattern on the second tipping paper web is aligned with the pattern on the first tipping paper web.

Figure 1:
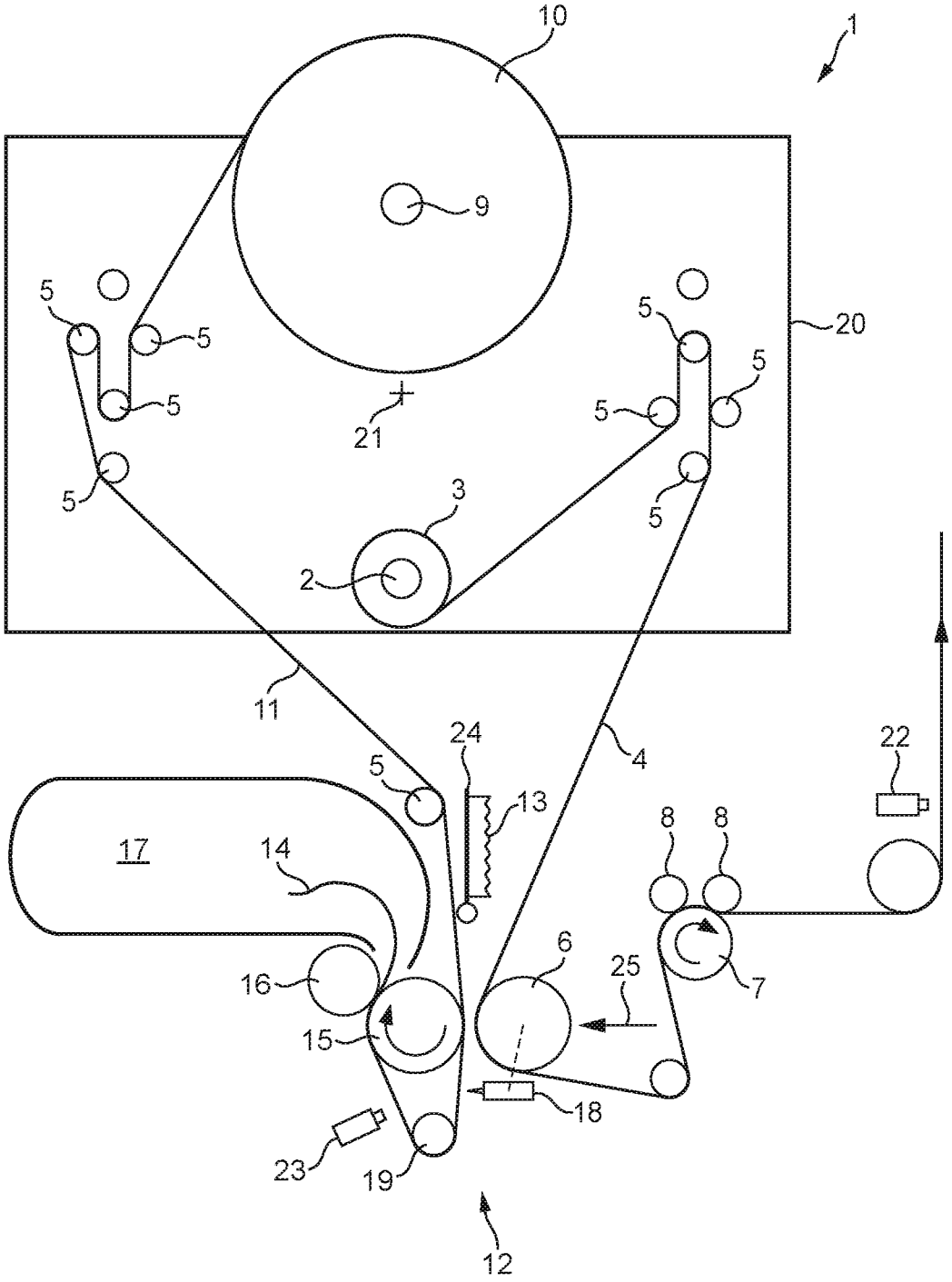
FIG. 1 shows a tipping paper feed assembly for use in smoking article manufacture, before a changeover has occurred.

FIG. 1 shows a tipping paper feed assembly 1 of apparatus for smoking article manufacture. The tipping paper feed assembly 1 has a first reel mount 2 that receives a first reel 3 of first tipping paper web 4 that is unwound and fed into subsequent apparatus that processes the tipping paper web 4 for manufacturing smoking articles.

As shown, the first tipping paper web 4 passes over several guide rollers 5, an idle roller 6 and a first drive roller 7. The guide rollers 5 and the idle roller 6 can freely rotate as the first tipping paper web 4 passes over them. The first drive roller 7 is driven by a motor and the first tipping paper web 4 is pinched between the first drive roller 7 and two nip rollers 8 so that the driven rotation of the first drive roller 7 pulls the first tipping paper web 4 through the tipping paper feed assembly 1. This causes the first tipping paper web 4 to be unwound from the first reel 3 and driven into the subsequent apparatus. The subsequent apparatus may also comprise a similar drive roller arrangement to pull the first tipping paper web 4 through the subsequent apparatus.

In this example, the first reel mount 2 is freely rotatable, so that the first tipping paper web 4 is unwound from the first reel 3 by the first drive roller 7, which pulls on the first tipping paper web 4. In other examples, the first reel mount 2 may include a brake or servo motor that resists or controls the speed at which the first reel 3 can rotate, thereby creating a tension in the first tipping paper web 4 as it is unwound.

Also shown in FIG. 1, the tipping paper feed assembly 1 also has a second reel mount 9 that receives a second reel lo of second tipping paper web 11.

Similarly to the first reel mount 2, the second reel mount 9 may be freely rotatable, or it may include a brake or servo motor that resists or controls the speed at which the second reel 10 can rotate as the second tipping paper web 11 is drawn through the apparatus for smoking article manufacture.

In the present example, the tipping paper feed assembly 1 comprises first and second reel mounts 2, 9 that support first and second reels 3, 10 of tipping paper web that are unwound as the tipping paper webs 4, 11 are drawn through the apparatus. However, in alternative examples, the first and second tipping paper webs 4, 11 may be supplied by other types of feed device.

The tipping paper feed assembly 1 is configured to allow changeover from the first reel 3 to the second reel 10 without stopping or slowing down the apparatus for smoking article manufacture. That is, tipping paper is fed into the subsequent apparatus for smoking article manufacture at a constant speed while the apparatus changes from the first reel 3 of first tipping paper web 4 to the second reel 10 of second tipping paper web 11.

The tipping paper feed assembly 1 comprises a splice mechanism 12 that attaches the second tipping paper web 11 to the first tipping paper web 4, so that the second tipping paper web 11 is pulled through the subsequent apparatus by the first tipping paper web 4. This facilitates changeover from the first reel 3 to the second reel 10.

The splice mechanism 12 attaches the second tipping paper web 11 to the first tipping paper web 4 using tape, glue, heat or other ways of joining the second tipping paper web 11 to the first tipping paper web 4. In this example, the splice mechanism 12 attaches the second tipping paper web 11 to the first tipping paper web 4 using tape, as explained in more detail hereinafter.

As shown in FIG. 1, prior to changeover, when the first reel 3 is running normally, the loose end 14 of the second tipping paper web 11 is fed over guide rollers 5, and around a guide roller 19 and a second drive roller 15. The second drive roller 15 is provided with a nip roller 16 that pushes the second tipping paper web 11 against the second drive roller 15 so that the second tipping paper web 11 is accelerated when the second drive roller 15 begins to rotate. In particular, the second drive roller 15 accelerates the second tipping paper web 11 prior to it being attached to the first tipping paper web 4.

As shown in FIG. 1, a reservoir 17 is provided in which the second tipping paper web ii accumulates as it is accelerated, before it is attached to the first tipping paper web 4. In alternative examples, the second tipping paper web 11 may be wrapped around the second drive roller 15 as the second tipping paper web 11 is accelerated. Therefore, the second tipping paper web 11 is accumulated on the second drive roller 15 as it is accelerated. In this case, there is no need for a reservoir 17.

When the speed of the second tipping paper web 11 matches or substantially matches the speed of the first tipping paper web 4, the second tipping paper web 11 is attached to the first tipping paper web 4, as described below.

Therefore, as the attachment between the second and first tipping paper webs 11, 4 is made, the speed of the second and first tipping paper webs 11, 4 may be the same or substantially the same. This reduces the stress induced in the second tipping paper web 11 and second reel 10 (which would otherwise have to accelerate quickly to match the speed of the first tipping paper web 4) and also provides for a better attachment.

As shown in FIG. 1, the first and second tipping paper webs 4, 11 are adjacent to each other and spaced as they pass into the splice mechanism 12 during normal operation. At the downstream end of the splice mechanism 12 the first tipping paper web 4 passes in one direction around the idle roller 6, and the second tipping paper web 11 passes in an opposite direction around the guide roller 19 and second drive roller 15. A space is provided between the idle roller 6 and the second drive roller 15, so that the first and second tipping paper webs 4, 11 do not contact each other in the splice mechanism 12 during normal operation.

A sensor may be provided to monitor the size of the first reel 3 of first tipping paper web 4, to determine the amount of first tipping paper web 4 remaining on the first reel 3. Alternatively, the first and second reel mounts 2, 9 may be driven by servo motors, and the servo motors can provide information on the rotational speed of the first and second reel mounts 2, 9. The rotational speed of the first reel mount 2 can be used to determine the amount of first tipping paper web 4 that remains on the first reel 10—given that the linear speed of the first tipping paper web 4 is substantially constant during normal operation of the tipping paper feed assembly 1, the greater the rotational speed, the less first tipping paper web 4 is remaining on the first reel mount 4. This also applies to the second reel mount 9 and second tipping paper web 11.

As the first reel 3 of first tipping paper web 4 is about to run out, the splice mechanism 12 is activated.

The splice mechanism 12 comprises a tape holder 24 that is provided in the space between the first and second tipping paper webs 4, 11, upstream of second drive roller 15. The tape holder 24 holds a piece of adhesive tape towards the second tipping paper web 11 during normal operation of the apparatus for smoking article manufacture. As explained below, the adhesive is for attaching the first and second tipping paper webs 4, 11 to each other for changeover from the first tipping paper web 4 to the second tipping paper web 11.

The tape holder 24 comprises an arm that pivots between an upright position and an engaged position. In the upright position the tape holder 24 is separated from the second tipping paper web 11, and so the adhesive tape does not contact the second tipping paper web 11. In the engaged position the tape holder 24 pivots down into the space between the first and second tipping paper webs 4, 11 ready for the splice to occur. The tape holder 24 may be manually pivoted into the engaged position, or an actuator may be provided so that this action occurs automatically.

Once the tape holder 24 has been pivoted into the engaged position, the idle roller 6, around which the first tipping paper web 4 travels, is moved towards the second drive roller 15 in the direction of arrow 25. An actuator, for example a pneumatic or electric actuator, or a motor, moves the idle roller 6 towards the second drive roller 15. The idle roller 6 may pivot about an axis, or may slide in a linear direction.

As the idle roller 6 is moved towards the second drive roller 15 the first tipping paper web 4 moves and comes into contact with the tape holder 24 and the adhesive tape contacts, and is transferred onto, the first tipping paper web 4.

Also, as the idle roller 6 is moved towards the second drive roller 15, the first tipping paper web 4 is pressed against the second tipping paper web 11 between the idle roller 6 and the second drive roller 15. Therefore, as the adhesive tape, which is on the first tipping paper web 4, passes between the second drive roller 15 and the idle roller 6 the first and second tipping paper 4, 11 webs are attached to each other by the adhesive tape.

Once attached to the first tipping paper web 4, the second tipping paper web 11 will be pulled over the first drive roller 7 and into the subsequent apparatus. As previously explained, when this attachment is made the speed of the second tipping paper web 11 is substantially the same as the speed of the first tipping paper web 4.

The adhesive tape which is transferred from the tape holder 24 onto the first tipping paper web 4 may extend all the way across the first tipping paper web 4 or may extend only partially across the first tipping paper web 4, provided that the first and second tipping paper webs 4, 11 are adequately attached to each other to form a splice.

Alternatively, if the tipping paper web 4, 11 includes any cut-out features, for example cut-lines, windows and/or apertures, the adhesive tape may be arranged on the tape holder 24 in positions corresponding to parts of the tipping paper web 4, 11 that do not include such features. Therefore, when the adhesive tape is transferred onto the tipping paper webs 4, 11 it is not aligned with any cut-lines, windows or apertures. This is advantageous because, if the adhesive tape were aligned with such features, then adhesive may be transferred from the adhesive tape onto any downstream rollers as the taped part of the tipping paper web passes over those rollers (through a cut-line, window or aperture).

The splice mechanism 12 also comprises a first cutter 13 that cuts off the remainder of the first tipping paper web 4. The splice mechanism 12 also comprises a second cutter 18 that cuts off the excess second tipping web 11 which has accumulated in the reservoir 17 or around the second drive roller 15.

The first cutter 13 comprises a blade that is attached to the tape holder 24. Once the tape holder 24 has pivoted down between the first and second tipping paper webs 4, 11 the blade is directed towards the first tipping paper web 4. Therefore, as the idle roller 6 moves towards the second drive roller 15 the first tipping paper web 4 is pushed against the blade of the first cutter 13. In this way, the first tipping paper web 4 is cut upstream of the tape attachment.

It will be appreciated that because the first cutter 13 is provided on the tape holder 14, the first tipping paper web 4 is cut in close proximity to the adhesive tape attachment. Therefore, only a small amount of first tipping paper web 4 will be trailing behind the adhesive tape attachment. Any first tipping paper web 4 that remains on the first reel 3 will stay in position, and will not be drawn through the apparatus for smoking article manufacture.

The second cutter 18 comprises a blade and is attached to the idle roller 6. As shown in FIG. 1, the first tipping paper web 4 passes around the idle roller 6 and between the idle roller 6 and second cutter 18. The blade of the second cutter 18 is arranged so that when the idle roller 6 moves towards the second drive roller 15 the blade is pushed against the second tipping paper web 11. The blade of the second cutter 18 is pushed against the second tipping paper web 11 between the second drive roller 15 and the guide roller 19. Therefore, the excess second tipping paper web 11 which has accumulated in the reservoir 17 or is wrapped around the second drive roller 15 is cut off.

It will be appreciated that the second cutter 18 is in close proximity to the second drive roller 15 and idle roller 6, so that the second tipping paper web 11 is cut close to the tape attachment. Therefore, only a small amount of excess second tipping paper web 11 will remain adjacent to the tape attachment after changeover from the first reel 3 to the second reel 10.

As described above, the splice mechanism 12 performs three actions:

- the first and second tipping paper webs 4, 11 are attached to each other using tape;
- the first tipping paper web 4 is cut upstream of the tape attachment;
- the second tipping paper web 11 is cut downstream of the tape attachment.

These three actions can be performed almost simultaneously, so that the first and second tipping paper webs 4, 11 are attached and cut at the same time.

The apparatus for smoking article manufacture is configured to reject smoking articles that are made using the region of tipping paper web that includes the attachment between the first and second tipping paper webs 4, 11. Smoking articles made using this region of the tipping paper web may be malformed and so a predetermined number of smoking articles made using the tipping paper web 4, 11 either side of the attachment between the first and second tipping paper webs 4, 11 are rejected.

Figure 2:
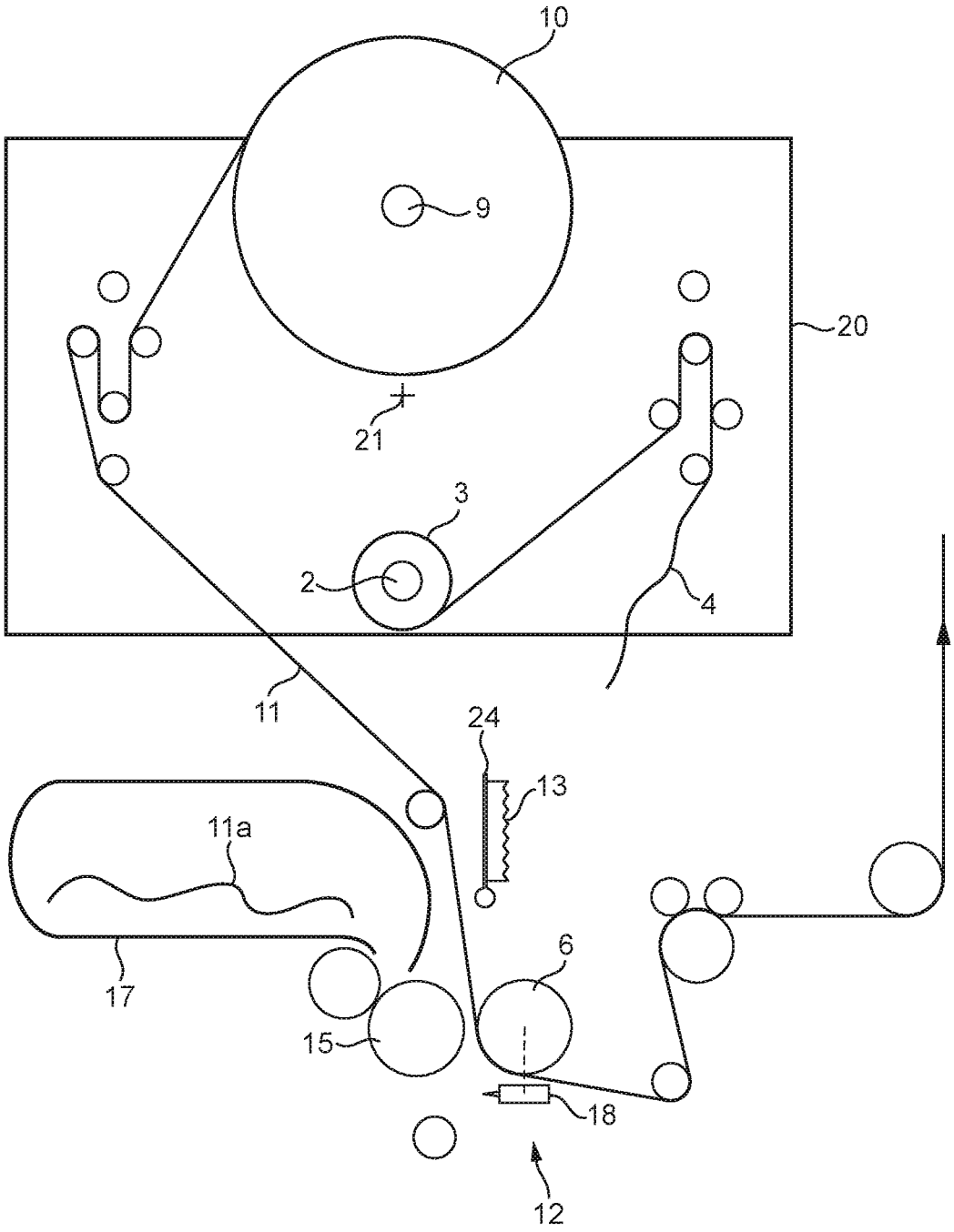
FIG. 2 shows the tipping paper feed assembly after a changeover has occurred; and, FIGS. 3*a* and 3*b* show an example of a tipping paper web.

FIG. 2 shows the tipping paper feed assembly 1 after changeover from the first tipping paper web 4 to the second tipping paper web 11. As shown, the first tipping paper web 4 is loose and the first reel 3 can be removed from the tipping paper feed assembly 1. The second tipping paper web 11 is now running over the idle roller 6 and through the subsequent apparatus to form smoking articles. An excess part 11*a* of the second tipping paper web 11 is disposed in the reservoir 17, having been cut off by the second cutter 18 after the first and second tipping paper webs 4, 11 were attached to each other.

After a first changeover and before a second changeover, the first and second reel mounts 2, 9 are configured to change places by rotating around each other. The first and second reel mounts and the guide rollers 5 are mounted on a rotatable member 20, such as a plate or an arm, that can be rotated about a pivot 21. Therefore, between subsequent changeovers, the first and second reel mounts 2, 9, together with the guide rollers 5, rotate about the pivot 21 so that the second reel 10, which is being depleted, assumes the position of the first reel 3 in FIG. 1*a*. In this position, a new first reel can be placed on the empty first reel mount 2 and the new first tipping paper web 4 can be threaded through the splice mechanism 12, including the second drive roller 15, and into the reservoir 17. The tipping paper feed assembly is thus prepared for the next changeover.

An electric motor, such as a servo motor may be provided to rotate the rotatable member 20 as described above. The servo motor can be configured to rotate at an appropriate speed to prevent fluctuations in the tension of the tipping paper web 4, 11. For example, if the rotatable member 20 is rotated too quickly then the tension in the tipping paper web 4, 11 may decrease and/or fluctuate, which can have a detrimental affect on downstream processes. Therefore, it is preferable to rotate the rotatable member 20 at a relatively slow, constant speed.

Before the first and second reel mounts 2, 9 are rotated the tape holder 24 and first cutter 13 are pivoted back to the upright position, to allow the second tipping paper web 11 to move across and assume the position of the first tipping paper web 4 shown in FIG. 1.

Some smoking articles include tipping paper patches that have a feature, for example a printed pattern, which may be aligned with the tobacco and filter rods prior to wrapping. This means that the tipping paper web is longitudinally registered to the point of cutting the tipping paper web into patches. For example, if the tipping paper patch were to include a printed logo, then this may be positioned in the middle of a cut patch.

It will also be appreciated that the tipping paper web may be longitudinally registered to other parts of the apparatus for smoking article manufacture, for example an adhesive applicator and/or other cutting means.

The longitudinal position of the tipping paper web refers to the position in the direction that the tipping paper web is travelling, as opposed to the transverse direction.

The tipping paper feed assembly 1, and in particular the splice mechanism 12, may include safety circuits that disable moving parts of the tipping paper feed assembly 1 when a machine operator is working within the tipping paper feed assembly 1. For example, prior to the splice mechanism being activated, while a machine operator may be positioning the second tipping paper web 11, the second drive roller 15 may be deactivated. The tipping paper feed assembly 1 may also be provided with physical guards having sensors that activate the safety circuits when the guards are opened. The safety circuits may be configured to only allow the splice mechanism 12 to be activated when the guards are closed.

The tipping paper feed assembly 1 described with reference to FIGS. 1 and 2 also comprises a registration system that registers the position of a feature of the second tipping paper web 11 to the position of a feature of the first tipping paper web 4 prior to attaching the second tipping paper web 11 to the first tipping paper web 4. Therefore, features on the second tipping paper web 11 are aligned with features on the first tipping paper web 4 as the first and second tipping paper webs 4, 11 are attached, which improves the downstream alignment between the tipping paper web and the apparatus for smoking article manufacture, which in turn reduces the number of smoking articles that are defective and/or rejected.

The registration system comprises a first sensor 22 disposed to detect at least one feature on the first tipping paper web 4. The registration system also comprises a second sensor 23 disposed to detect at least one feature on the second tipping paper web 11.

In this example, the first sensor 22 is positioned downstream of the splice mechanism 12, in particular downstream of the idle roller 6. In FIG. 1 the first sensor 22 is positioned near the output of the tipping paper feed assembly 1.

In this example, the second sensor 23 is positioned downstream of the splice mechanism 12, in particular downstream of the idle roller 6, and before the second tipping paper web 11 enters the reservoir 17. In FIG. 1, the second sensor 23 is disposed immediately before the second tipping paper web 11 passes between the second drive roller 15 and the nip roller 16.

However, it will be appreciated that the first and second sensors 22, 23 may be positioned anywhere along the first and second tipping paper webs 4, 11 respectively. For example, the first and second sensors 22, 23 may be positioned upstream of the splice mechanism, downstream of the splice mechanism (as described above) and may even be mounted on the rotatable member 20.

The positions of the first and second sensors 22, 23 relative to the tipping paper webs 4, 11 will depend on the features on the first and second tipping paper webs 4, 11 which the first and second sensors 22, 23 are arranged to detect. Therefore, the first and second sensors 22, 23 can be positioned anywhere across the width of the tipping paper webs 4, 11 in the transverse direction. For example, the first second 22 may be positioned centrally of the first tipping paper web 4, while the second sensor 23 may be positioned towards one edge of the second tipping paper web 11.

The position of the first and second sensors 22, 23 may be adjustable. For example the first and second sensors 22, 23 may be disposed on adjustable mounts which allow the first and second sensors 22, 23 to be positioned across the tipping paper web 4, 11 to suit the position of the features to the detected. Furthermore, the first and second sensors 22, 23 may be rotated to detect an opposite side of the tipping paper web 4, 11. For example, the adjustable mounts may be rotatable to move the first and/or second sensors 22, 23 to either side of the tipping paper web 4, 11.

The first and second sensors 22, 23 provide information on the positions of features on the first and second tipping paper webs 4, 11 to a controller (not shown), which determines the relative positions of features on the first and second tipping paper webs 4, 11. The controller can then control the speed of the second drive roller 15, so that the second tipping paper web 11 can be accelerated or decelerated to register the second tipping paper web 11 to the first tipping paper web 4.

The first and second sensors 22, 23 can also provide real-time, accurate information on the linear speed of the first and second tipping paper webs 4, 11. This can help the splice mechanism to more accurately match the speeds of the first and second tipping paper webs 4, 11 prior to attaching the first and second tipping paper webs 4, 11 together.

It will be appreciated that the controller is therefore configured to control the speed of the second drive roller 15 such that the second tipping paper web 11 is accelerated to match the speed of the first tipping paper web 4, and at the same time the second tipping paper web 11 is brought into register with the first tipping paper web 4.

As previously explained, the first and second sensors 22, 23 are able to detect at least one feature of the first and second tipping paper webs 4, 11, respectively. The first and second sensors 22, 23 may be able to detect a printed feature or pattern on the surface of the first and second tipping paper webs 4, 11, respectively. The printed feature may be included specifically to allow the first and second tipping paper webs 4, 11 to be registered to each other.

Alternatively, the first and second sensors 22, 23 may detect a cut line, cut-out, or other edge of the first and second tipping paper webs 4, 11. For example, the first and second tipping paper webs 4, 11 may include a series of windows, and the first and second sensors may be configured to detect the positions of those windows.

Figure 3A:
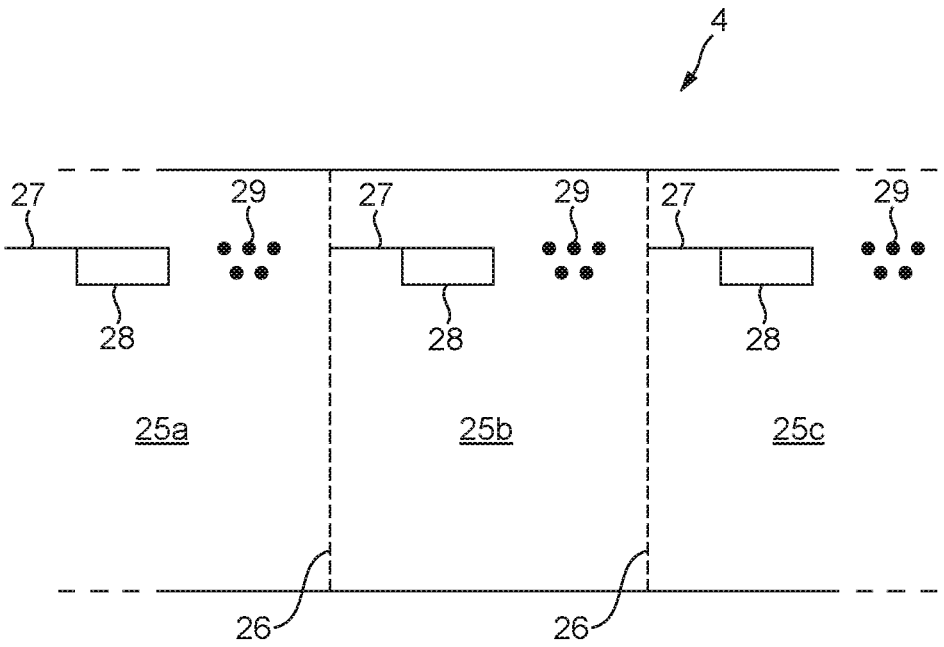
Figure 3B:
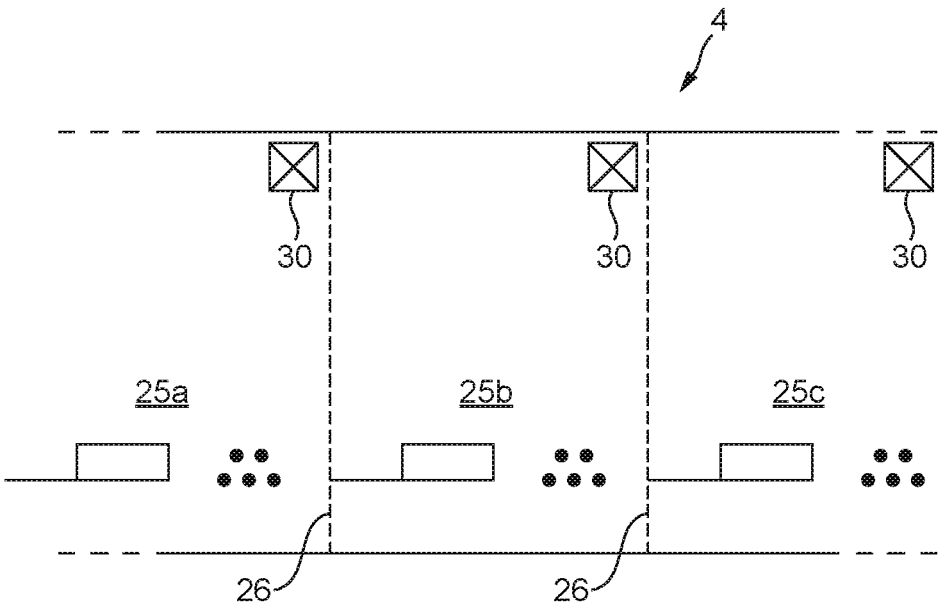

FIGS. 3*a* and 3*b* show opposite sides of an example of a tipping paper web 4, 11. As shown, the tipping paper web 4, 11 has a repeating pattern of features. Representative lines 26 indicate the position in which the tipping paper web 4, 11 is cut to form tipping paper patches 25*a*, 25*b*, 25*c*. As shown, each of the successive tipping paper patches 25*a*, 25*b*, 25*c* has a pattern of features, which is repeated along the tipping paper web 4, 11.

As shown in FIG. 3*a*, in this example the tipping paper web 4, 11 comprises a cut line 27, a window 28, and a group of perforations 29. As shown in FIG. 3*b*, the opposite side of the tipping paper web 4, 11 comprises a printed eye-mark 30. The opposite side of the tipping paper web 4, 11, as shown in FIG. 3*b*, may be the side which is placed against the tobacco and filter rod components when smoking articles are made, so that the eye-mark 30 is not visible on the assembled cigarette.

The first and second sensors 22, 23 may be disposed to detect features on opposite sides of the first and second tipping paper webs 4, 11, respectively. Referring to the example of Figures 3*a* and 3*b*, the first sensor 22 may be disposed to detect the position of the window 28 from a top side of the first tipping paper web 4, which is facing outwards when the cut tipping paper patch is wrapped around tobacco and filter rod components to form smoking articles. Meanwhile, the second sensor 23 may be disposed to detect the position of the eye-mark 30 on the underside of the second tipping paper web 11, which would be in contact with the tobacco and filter rod components when the cut tipping patch is wrapped to form a smoking article.

The registration system can be configured to use the information from the first and second sensors 22, 23 to control the second drive roller 15 in such a way that the relative positions of the eye-mark of the second tipping paper web 11 and the window 28 of the first tipping paper web 4 are registered prior to attaching the second tipping paper web 11 to the first tipping paper web 4.

In this way, the repeating patterns on the first and second tipping paper webs 4, 11 are aligned when the second tipping paper 11 is attached to the first tipping paper web 4.

As used herein, the terms "upstream" and "downstream" will be understood to refer to the direction of movement of the tipping paper web. That is, the tipping paper web moves from an upstream location to a downstream location.

Therefore, the term "upstream" will be understood to mean a position which is displaced in the opposite direction to the direction of movement of the tipping paper web. The term "upstream" will be also understood to mean a direction which is opposite direction to the direction of movement of the tipping paper web.

Similarly, the term "downstream" will be understood to mean a position which is displaced in the same direction as the direction of movement of the tipping paper web. The term "downstream" will be also understood to mean in the same direction as the direction of movement of the tipping paper web.

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products. The smoking article may be provided with a filter for the gaseous flow drawn by the smoker.

As used herein, the term "tipping paper" includes and material suitable for attaching the filter to a rod of smokeable material and therefore includes any suitable type of paper, metallic foil, or other sheet material.

In order to address various issues and advance the art, the entirety of this disclosure shows by way of illustration various embodiments in which the claimed invention(s) may be practiced and provide for a superior tipping paper feed assembly for use in smoking article manufacture. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, pails, steps, means, etc. In addition, the disclosure includes other inventions not presently claimed, but which may be claimed in future.

The invention claimed is:

1. A tipping paper feed assembly for use in smoking article manufacture, the tipping paper feed assembly comprising:

a first feed device adapted to supply a first tipping paper web that is fed into apparatus for smoking article manufacture;

a second feed device adapted to supply a second tipping paper web;

a splice mechanism adapted to attach the first and second tipping paper webs together for changeover between the first and the second feed devices, the splice mechanism being configured to move the first tipping paper web towards the second tipping paper web and including a tape holder that holds adhesive tape to attach the first and second tipping paper webs together as said first tipping paper web moves towards the second tipping paper web; and, a registration system configured to register features of each tipping paper web prior to attaching said first and second tipping paper webs together with said features in register, wherein the splice mechanism comprises a first cutter adapted to cut the first tipping paper web, said first cutter being mounted on the tape holder so that said first tipping paper web is cut as the first tipping paper web is moved towards the second paper web and the first and second tipping paper webs are attached to each other with said adhesive tape.

2. The tipping paper feed assembly of claim 1, further comprising an accelerating roller configured to accelerate the second tipping paper web prior to the splice mechanism attaching the first and second tipping paper webs together.

3. The tipping paper feed assembly of claim 2, wherein the accelerating roller is configured to accelerate the second tipping paper web until the speed of the second tipping paper web substantially matches the speed of the first tipping paper web.

4. The tipping paper feed assembly of claim 2, further comprising a reservoir into which the second tipping paper web is directed prior to the splice mechanism attaching the first and second tipping paper webs together.

5. The tipping paper feed assembly of claim 1, wherein the registration system comprises a first sensor arranged to detect a feature of the first tipping paper web.

6. The tipping paper feed assembly of claim 5, wherein the registration system comprises a second sensor arranged to detect a feature of the second tipping paper web.

7. The tipping paper feed assembly of claim 6, wherein at least one of the first and second sensors is configured to detect a printed mark.

8. The tipping paper feed assembly of claim 6, wherein at least one of the first and second sensors is configured to detect an edge.

9. The tipping paper feed assembly of claim 6, wherein the first sensor is disposed to detect the first web of tipping paper downstream of the splice mechanism.

10. The tipping paper feed assembly of claim 6, wherein the second sensor is disposed to detect the second web of tipping paper downstream of the splice mechanism.

11. The tipping paper feed assembly of claim 1, wherein the splice mechanism further comprises a second cutter adapted to cut off excess material from the second tipping paper web during changeover from the first feed device to the second device.

12. Apparatus for smoking article manufacture comprising the tipping paper feed assembly of claim 1.

13. A method of assembling smoking articles comprising:

feeding a first tipping paper web from a first feed device to a tipping unit adapted to assemble smoking articles;

attaching first and second tipping paper webs together for changeover from the first feed device to a second feed device that feeds said second tipping paper web by moving the first tipping paper web towards the second tipping paper web so that adhesive tape held by a tape holder attaches said first and second tipping paper webs together;

registering a feature of each tipping paper web prior to attaching the said first and second tipping paper webs together in register, and cutting the first tipping paper web using a first cutter mounted on the tape holder so that the first tipping paper web is cut as the first tipping paper web is moved towards the second tipping paper web and the first and second tipping paper webs are attached to each other with said adhesive tape.

14. The method of claim 13, further comprising accelerating the second tipping paper web prior to attaching the first and second tipping paper webs together.

15. A tipping paper feed assembly for use in smoking article manufacture, the tipping paper feed assembly comprising:

a first feed device adapted to supply a first tipping paper web that is fed into apparatus for smoking article manufacture;

a second feed device adapted to supply a second tipping paper web;

a splice mechanism adapted to attach the first and second tipping paper webs together for changeover between the first and the second feed devices; and, a registration system configured to register features of each tipping paper web prior to attaching said first and second tipping paper webs together with said features in register, wherein the registration system comprises a first sensor arranged to detect a feature of the first tipping paper web, and a second sensor arranged to detect a feature of the second tipping paper web, wherein at least one of the first and second sensors is configured to detect a cut line.

* * * * *